United States Patent [19]

Nicolosi et al.

[11] 4,089,330

[45] May 16, 1978

[54] PHYSICAL THERAPY APPARATUS AND METHOD

[76] Inventors: Joseph P. Nicolosi, 6539 Peggy Dr., Baton Rouge, La. 70808; Michael M. Turner, 3603 Verde Ave., Pascagoula, Miss. 39567

[21] Appl. No.: 787,693

[22] Filed: May 2, 1977

[51] Int. Cl.[2] ..... A61H 1/02

[52] U.S. Cl. ..... 128/25 R

[58] Field of Search ..... 128/25 R, 2 S

[56] References Cited

U.S. PATENT DOCUMENTS

| | | | |
|---|---|---|---|
| 2,139,166 | 12/1938 | Leuchter | 128/25 R |
| 2,284,061 | 5/1942 | Korte | 128/25 R |
| 2,387,966 | 10/1945 | Zander | 128/25 R |
| 3,894,534 | 7/1975 | Graves et al. | 128/25 R |

FOREIGN PATENT DOCUMENTS

| | | | |
|---|---|---|---|
| 385,362 | 3/1908 | France | 128/25 R |
| 308,886 | 11/1918 | Germany | 128/25 R |
| 111,562 | 12/1917 | United Kingdom | 128/25 R |
| 115,486 | 5/1918 | United Kingdom | 128/25 R |

*Primary Examiner*—Lawrence W. Trapp

[57] ABSTRACT

A physical therapy apparatus and method are provided for increasing the range of motion of joints, such as knee and elbow joints, that have lost their normal range of mobility. The apparatus includes support means for positioning and supporting the upper limb of an arm or leg, cradle means for positioning and supporting the lower limb of the same arm or leg which are pivotally connected to the support means so that the resulting axis of rotation coincides with the axis of rotation at the joint between the lower and upper limb positioned thereon, positioning means for selectively setting the position of the cradle means relative to the support means at a desired initial treatment position which does not exceed the allowable pain tolerance of the patient whose joint is being treated, reciprocating means which reciprocate the cradle means from the initial treatmemt position to a variable terminal treatment position to provide continuous uniform passive manipulation of the lower limb so that stretching of the soft tissues in the joint takes place and the range of motion of the joint is gradually increased, variable stroke means to permit the variable terminal treatment position of the cradle means to be controllably varied, and variable power means to operably drive the reciprocating means to provide a predetermined amount of force applied against the cradle means to achieve the desired physical therapy effect at the joint but that can also be resisted and successfully overridden by the patient wherever too much pain or discomfort is experienced.

36 Claims, 7 Drawing Figures

PHYSICAL THERAPY APPARATUS AND METHOD

BACKGROUND

When a joint, such as a knee or elbow joint, is immobilized while healing from an injury, after an operation, or as a result of disease, the soft tissues at the joint contract. Motion of the joint is limited both by actual physical restraint due to the soft tissues which have contracted and by psychological restraint due to the pain that is encountered when the soft tissues are stretched. However, to return the joint to its normal range of mobility the soft tissues must be stretched to increase the range of motion of the joint.

Stretching of the soft tissues is best carried out by passive manipulation of the joint since the muscles that operate the joint are in a weakened condition as a result of immobilization. During manipulation of the joint, pain will result as scar tissue and adhesions are broken off. The pain encountered during passive manipulation of the joint must be controlled and always held below the patient's allowable pain tolerance as exceeding a patient's pain tolerance can cause new adhesions to be formed and result in regression in the condition of the joint. Operation in a comfort zone within the patient's allowable pain tolerance is also important since stretching of the soft tissues is facilitated as the patient relaxes and tense muscles are overcome by weariness. To continually assure operation in the comfort zone, the stretching necessarily must be carried out gradually over an extended period of time.

The use of the apparatus of this invention to provide uniform and continuous mechanical therapy rather than depending solely upon manual therapy is desirable as it is impractical for a physical therapist to manually manipulate a joint for an extended period of time for several reasons. First, the therapist will not have the stamina to continue the treatment in a uniform and consistent manner for an extended period of time. However, the apparatus of this invention can provide continuous uniform treatment for an extended period. Secondly, the cost of treatment that would require a skilled physical therapist's constant attendance and total involvement for extended periods of time would be quite expensive. On the other hand, the apparatus of this invention can manipulate the joint over an extended period of time without the physical therapist being in attendance, resulting in lower cost for therapy. Thirdly, a skilled physical therapist must generally rely on a trial and error approach through his sense of feel to establish the range of motion of the joint that was attained in the previous treatment so as to use it as a starting point for the next treatment, to establish a specific desired angle through which the joint is reciprocated during treatment, and to establish a specific desired amount of force to be applied during the treatment. If a physical therapist exceeds the patient's pain tolerance, he may cause regression in the condition of the patient or at the very least cause pain and discomfort to the patient. However, the apparatus of this invention can be controlled so as to accurately and repeatably position the joint from one treatment to the next for a desired range of motion. Furthermore, the apparatus of this invention additionally permits accurate control of the angle through which the joint is reciprocated during passive manipulation of the joint and of the amount of force applied during the manipulation.

SUMMARY

This invention refers to a physical therapy apparatus and method for increasing the range of motion in a joint that has reduced mobility. The range of motion is increased by gradually stretching the soft parts of the joint such as muscles and ligaments by passive manipulation of the joint while remaining within the pain tolerance of the patient.

In one preferred embodiment of this invention, a physical therapy apparatus includes support means for positioning and supporting the upper limb of an arm or leg, cradle means for positioning and supporting the lower limb of the same arm or leg which are pivotally connected to the support means so that the resulting axis of rotation coincides with the axis of rotation at the joint between the lower and upper limb positioned thereon, positioning means for selectively setting the position of the cradle means relative to the support means at a desired initial treatment position which does not exceed the allowable pain tolerance of the patient whose joint is being treated, reciprocating means which reciprocate the cradle means from the initial treatment position to a variable terminal treatment position to provide continuous uniform passive manipulation of the lower limb so that stretching of the soft tissues in the joint takes place and the range of motion of the joint is gradually increased, variable stroke means to permit the variable terminal treatment position of the cradle means to be controllably varied, and variable power means to operably drive the reciprocating means to provide a predetermined amount of force applied against the cradle means to achieve the desired physical therapy effect at the joint but that can also be resisted and successfully overridden by the patient whenever too much pain or discomfort is experienced.

An object of this invention is to provide an apparatus and method for passively manipulating a joint of a patient, such as a knee or elbow joint, so that therapy in the form of uniform and continuous passive manipulation is provided for as long as desired without the continued presence of a physical therapist after the variables of the apparatus have been initially set.

A further object is to accurately control the range of motion at which the joint is passively manipulated and to precisely control the increments the range of motion is increased from one treatment to the next.

A further object is to permit controlled changes in the angle through which the joint is reciprocated and in the force applied during passive manipulation of the joint.

A further object is to permit measurement of the progress of a patient so as to allow repeatability in setting the apparatus for a desired range of motion, or for a desired angle through which the joint is reciprocated, or for a desired force applied so that there is a high degree of consistency from one treatment to the next.

A further object is to provide an apparatus and method for controlling the force applied to passively manipulate a joint so that the force applied can be resisted and successfully overridden by the patient whenever too much pain or discomfort is experienced.

One further object is to provide an apparatus that is adaptable for either mode of motion, i.e. flexion or extension, of a joint operating in a single plane.

Various other objects, advantages, and features of the invention will become apparent to those skilled in the art from the detailed description of the preferred embodiment taken in conjunction with the accompanying drawings.

DESCRIPTION OF THE DRAWINGS

The invention will be explained in conjunction with an illustrative embodiment shown in the accompanying drawings, in which.

DESCRIPTION OF PREFERRED EMBODIMENT

Figure 1:
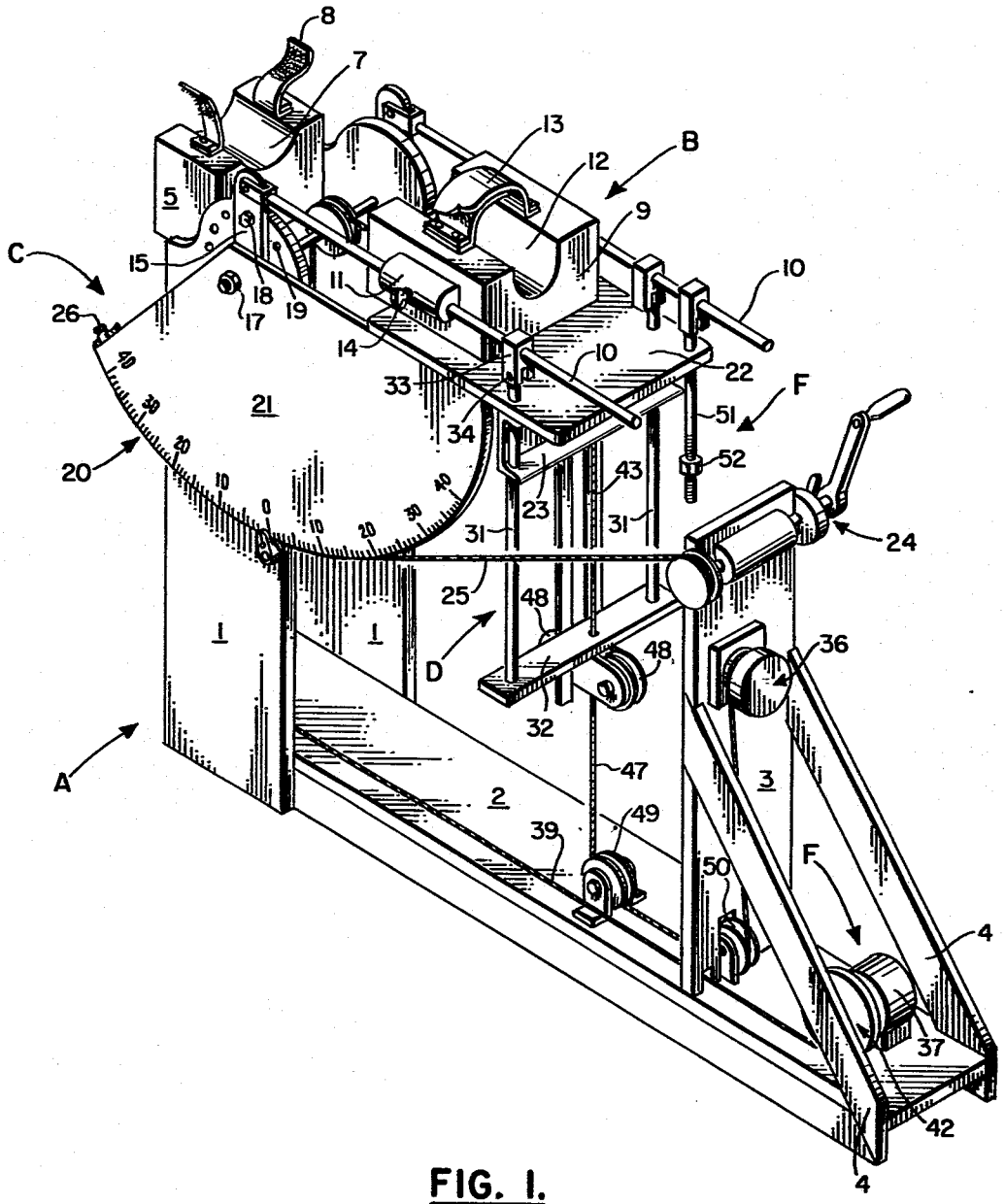
FIG. 1 is a perspective view of a physical therapy apparatus formed in accordance with the invention.
Figure 2:
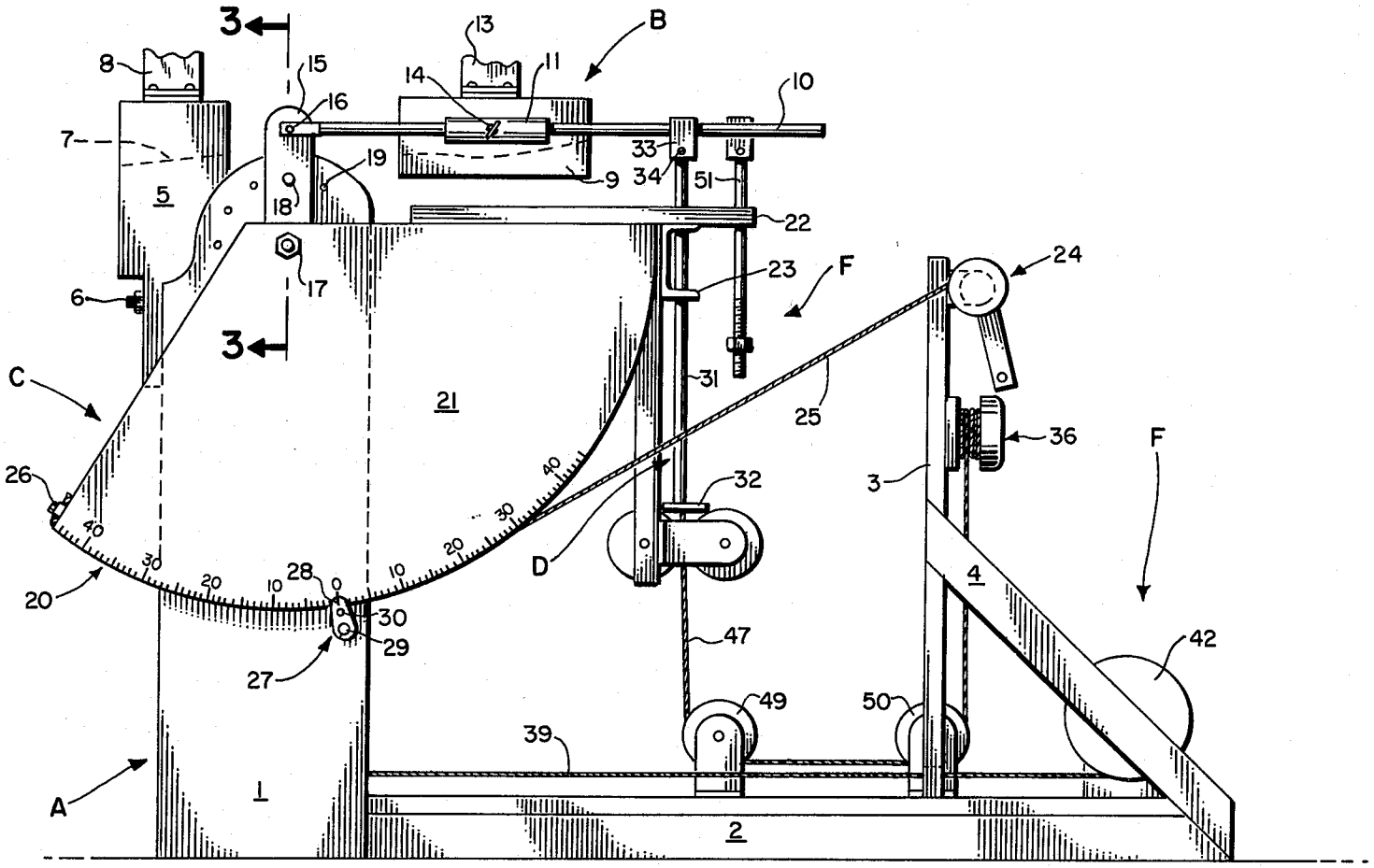
FIG. 2 is a side elevational view of the apparatus of FIG. 1.

Referring to the drawings in detail and in particular FIGS. 1–4, there is provided a physical therapy apparatus having support means indicated generally at A, cradle means indicated generally at B pivotally connected to support means A, positioning means indicated generally at C positioning cradle means B relative to support means A at an initial treatment position, reciprocating means indicated generally at D which reciprocate cradle means B from the initial treatment position to a variable terminal treatment position, variable stroke means indicated generally at F to regulate the stroke of reciprocating means D and thus permit the variable terminal treatment position of cradle means B to be controllably varied, and variable power means indicated generally at E (best shown in FIG. 4 and including a system of variable weight means, variable rewind reel means, pulley means, and motor means) to operably drive reciprocating means D.

Support means A includes upstanding support means 1, horizontal base support 2 secured to upstanding support means 1, winch and rewind reel support 3, and diagonal braces 4. Although upstanding support means 1 is capable of positioning and supporting the upper limb of an arm or leg at the uppermost end of the upstanding support means, preferably the support means A will also include upper limb cradle 5 which is rigidly attached to upstanding support means 1 by fasteners 6. The upper leg or the upper arm of the patient is positioned in upper limb cradle 5 during treatment. Upper limb cradle 5 includes padded cradle 7 which is padded and contoured for the patient's comfort. Elastic soft padding is provided to spread the load comfortably. The padding is covered with a soft, breathable material for greater comfort. Upper limb cradle 5 also is equipped with straps 8 so that the upper limb can be securely held in position. Velcro fasteners on straps 8 provide a uniform restraining force. Different size cradles are available to suit different limbs and different-size patients, and the various size cradles are easily interchanged by removal of fasteners 6. The upper limb cradle 5 and upstanding support means 1 are provided with upper limb cradle height adjustment means such as slotted holes (not shown) provided in seriatim fashion in the upper limb cradle 5 or in upstanding support means 2 for the fasteners 6 to pass through to permit vertical or other adjustment of the upper limb cradle 5 with respect to the upstanding support means 1. The upper limb cradle height adjustment means provides adequate adjustment to compensate for the individual patient or the particular limb being treated, and the desired range of motion that the apparatus will be operating in. The upper limb cradle height adjustment means further allows a proper degree of adjustment so that the axis of rotation of the joint being treated and the axis of rotation of the cradle means B relative to support means A can be made to coincide. This is important to assure accurate control of the joint and to prevent any chafing action on the limb of the patient. A further feature of this invention is the compact, portable nature of the apparatus. In view of this, the support means A can be provided with transport means (not shown), such as casters, to permit easy movement of the apparatus from one room to another and also can be provided with height adjustment means (not shown), such as jack screws, to permit adjustment of the height of the apparatus with respect to the particular table or chair upon which the patient is resting during treatment.

Cradle means B includes lower limb cradle 9 and actuator rod means. In the preferred embodiment the actuator rod means comprises two actuator rods 10 aligned parallel to one another and positioned along opposite sides of the lower limb cradle 10. Lower limb cradle 9 is connected to actuator rods 10 by tubes 11 which are securely attached to both sides of the lower limb cradle 9. Actuator rods 10 are slidable through tubes 11 so that lower limb cradle 9 is adjustable along the length of actuator rods 10 to permit proper positioning of the lower limb cradle 9 for the patient's comfort. Once the lower limb cradle 9 is adjusted to the desired position, it can be held in position with respect to actuator rods 10 by thumb screws 14 or other similar means.

Figure 3:
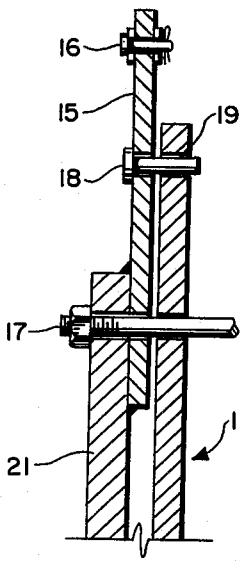
FIG. 3 is a partial sectional view taken along line 3—3 of FIG. 2.

The lower leg or the lower arm of the patient is positioned in lower cradle 9 during treatment. In similar fashion to upper limb cradle 5, lower limb cradle 9 includes padded cradle 12 which is padded and contoured for the patient's comfort. Elastic soft padding is provided to spread the load comfortably. The padding is covered with a soft, breathable material for greater comfort. Lower limb cradle 9 is also equipped with straps 13 so that the lower limb can be securely held in position. Velcro fasteners on straps 13 provide a uniform restraining force. Different size cradles are available to suit different limbs and different-size patients, and the various cradles are easily interchanged since lower limb cradle is easily slidable off actuator rods 10 when the rods have been disconnected at either end. Actuator rods 10 are connected to pivot arms 15 so as to pivot relative to support means A so that when the upper limb is positioned on support means A, preferably in upper limb cradle 5, and the lower limb is positioned in lower limb cradle 9, the resulting axis of rotation of actuator rods 10 as they are pivoted relative to the support means A coincides with the axis of rotation at the knee or elbow joint of the lower limb as it pivots relative to the upper limb. This coincidence of axis of rotation is of foremost importance since the scheme of operation of this invention is to provide a form of motion that patterns the motion of the joint. The axis of rotation of actuator rods 10 is at pin 16 which pivotally connects actuator rod 10 with pivot arm 15 (pin 16 is best illustrated in FIG. 3). Pivot arm 15 is pivotally connected to support means A by shaft 17 and is rotatable about shaft 17 to various positions. This permits adjustment of pivot arm 15 in order to provide the proper clearance for the elbow or knee joint in the various ranges of operation. It also permits the axis of rotation of the lower limb about the joint to be realigned to coincide with the axis of rotation of the actuator rods 10 about pin 16 after the actuator rods 10 have been repositioned through a nominal angle by positioning means C. After pivot arm 15 is appropriately positioned, it is held in position and prevented from further rotation with respect to support means A, and more particularly upstanding support means 1, by pin 18 which passes through the alignment hole in pivot arm 15 and through a hole 19 in upstanding support means 1. There are a number of holes 19 in upstanding support means 1 arranged in seriatim fashion to permit locking of pivot arm 15 in the various positions that may be required for the different operating ranges of the apparatus.

Positioning means C includes actuator frame means 20, rotating means 24 and 25 to rotate the actuator frame means, and locking means 27 to lock the actuator frame means into position after rotation to a desired initial treatment position. The function of positioning means C is to position cradle means B and thus the lower limb in an initial treatment position and at a range of motion which causes the joint to be in a condition which is near or at its maximum flexional and/or extensional capacity without exceeding the patient's allowable pain tolerance. Actuator frame means 20 includes at least one and preferably two actuator frame sides 21 aligned parallel to one another, actuator frame top 22 secured to and interconnecting actuator frame sides 21, and actuator frame bracket 23 depending from and securely attached to the underside of actuator frame top 22. Actuator frame means 20 is pivotally connected to upstanding support means 1 by shaft 17. When actuator frame means 20 is pivoted about shaft 17 so as to be rotated with respect to upstanding support means 1, it causes cradle means B, positioned above and in contact with actuator frame means 20, to have substantially coincident pivotal movement. In this manner actuator frame means 20 positions cradle means B and thus the lower limb at the initial treatment position. Rotating means are provided for rotating the actuator frame means 20 to the initial treatment position. Rotating means illustrated include hand winch 24, either a double drum winch or two winches, and cable 25 attached to actuator frame means 20 by clamping means 26 but other similar and conventional means of rotation are also envisioned. Once the actuator frame means 20 has been rotated to the initial treatment position by the rotating means, locking means 27 are provided to lock actuator frame means 20 into position. Locking means 27 includes a combination lock plate and indexing mark 28 attached to frame pin 29 to keep it aligned and locking screw 30 for tightening down. After the actuator frame side 21 has been rotated to the initial treatment position, lock screw 30 is tightened down to clamp actuator frame side 21 between lock plate/indexing mark 28 and upstanding support frame means 1. The frictional forces developed by this clamping action hold the actuator frame means 20 in position. While only one locking device is required to safely hold the actuator frame means in position, duplicate locking devices can be provided on both sides to permit locking on either or both sides of the apparatus. A backup locking means is also provided by using a conventional ratcheting device in conjunction with hand winch 24 so that as rotation of the actuator frame means 20 takes place it will not be free to fall. Actuator frame sides 21 have indexing means, such as peripheral calibration marks, on actuator frame sides 21. Indexing mark 28 used in conjunction with the calibration marks provide an accurate means to accurately and controllably position the actuator frame means 20 at a desired intial treatment position. This indexing feature of the invention minimizes any chance that the patient's allowable pain tolerance will be exceeded since it permits the final position that the patient discontinued treatment at in the previous session to be repeated before incremental increases in range of motion are attempted. A further advantage of this indexing feature is that accurate and controlled increases in the range of motion can be effected. Yet another advantage of this indexing feature is that the patient's progress can be accurately measured over a period of time.

Reciprocating means D includes push rods 31, and horizontal plate 32 which is securely attached to the lower ends of push rods 31. Push rods 31 pass through and are slidable with respect to actuator frame top 22, and with the aid of sliding bearings are slidable through actuator frame bracket 23 which keeps the push rods accurately aligned. Eash push rod 31 is connected at its upper end to an actuator rod 10, slide bearing 33 and pin 34. Pin 34 allows actuator rod 10 to pivot in slide bearing 33 during normal operation when reciprocating means D function to reciprocate cradle means B from the initial treatment position which has been set by positioning means C to a variable terminal treatment position. This reciprocating movement will provide a corresponding continuous reciprocal pivotal movement of the lower limb relative to the upper limb since they are positioned in the cradle means B and support means A respectively.

Figure 4:
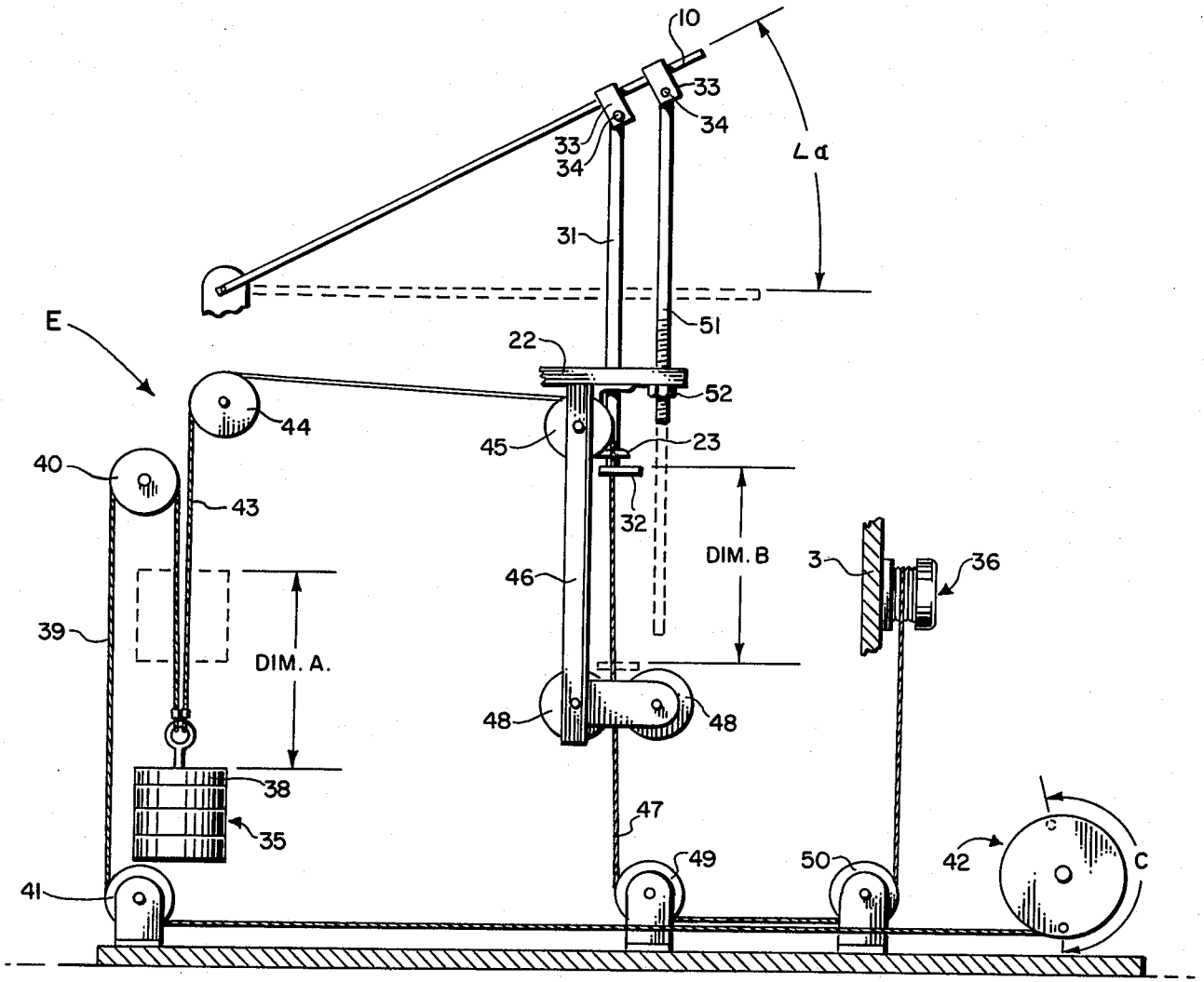
FIG. 4 is a side elevational view with support means and with most of the structure of the support means, positioning means, and cradle means removed so as to better illustrate the variable power means.

Variable power means E includes variable weight means 35, variable rewind reel means 36, motor means 37, and pulley means (Best shown in FIG. 4). Variable weight means 35 has multiple discs 38 that permits incremental increases or decreases in the total weight of weight means 35.

Variable weight means 35 is securely connected to motor means 37 by pulley means. The pulley means comprises cable 39 and pulley or sheaves 40 and 41. Cable 39 is securely attached on one end to variable weight means 35, routed over pulley or sheaves 40 and 41 which guide and provide the direction of cable motion, and securely attached on the other end to rotatable drum 42. Rotatable drum 42 is securely attached to and driven by motor means 37, which in the preferred embodiment is a reversible gear motor. Variable weight means 35 is securely connected to reciprocating means D, and specifically to horizontal plate 32, also by pulley means. This pulley means comprises cable 43 and pulley or sheaves 44 and 45. Cable 43 is securely attached on one end to variable weight means 35, routed over pulley or sheaves 44 and 45 which guide and provide the direction for cable motion and securely attached on the other end to horizontal plate 32. Pulley 44 rotates on shaft 17. With pulley 44 mounted on shaft 17, the stroke of push rods 31 (see FIG. 4 where stroke is illustrated by DIM. B and angle $\alpha$) will remain constant during changes of position of the actuator frame means 20. A bracket 46 supports pulley 45 and in securely attached to the underside of actuator frame top 22.

Variable rewind reel means 36 is securely connected to reciprocating means D, and specifically to horizontal plate 32, by pulley means. The pulley means comprises cable 47 and pulley or sheaves 48, 49, and 50. Cable 47 is attached to the lower side of horizontal plate 32, then is routed through pulleys 48, 49, and 50 to rewind reel means 36. Rewind reei means 36 ultilizes a constant force torsion spring which provides a relatively constant force as cable 47 is wound up or is unwound. The torsion spring in rewind reel means 36 can be adjusted to permit variation in the force applied to reciprocating means D.

Variable power means E operably drives reciprocating means D in the following manner. Motor means 37 runs in one direction and rotates drum 42 so that cable 39 winds up on drum 42 causing variable weight means 35 to be pulled through an upward stroke as it is lifted in a vertical movement through space. Simultaneously, the slack in cables 43 and 47 will be taken up as rewind reel means 36 exerts a force to pull reciprocating means D through a concomitant downward stroke. The opposite cycle occurs after variable weight means 35 has reached its uppermost position as indicated in the dotted phantom view of weight means 35 in FIG. 4. Motor means 37 can then either be de-energized permitting the weight means 35 to slowly move down acting through the gear train or the motor 37 can be reversed causing weight means 35 to move downward more rapidly to return to its initial position. The force of rewind reel means 36 opposes the force of variable weight means 35 in its downward stroke, but it does not prevent the downward stroke since the force of rewind reel means 36 is adjusted so as to be less than the force of variable weight means 35. During the downward stroke of variable weight means 35 there is a concomitant upward stroke of reciprocating means D as shown in FIG. 4 moving from its lowermost position to its uppermost position and represented by DIM. B. The force applied to reciprocating means D during its upward stroke will be the force of variable weight means 35 minus the force of rewind reel means 36. Since both the variable weight means 35 and variable rewind means 36 are adjustable as to the amount of force, this adjustment permits variation and controlled regulation of the force applied to the reciprocating means D. Another embodiment (not shown) of a counteracting force which can be used as a substitute for the illustrated rewind reel means 36 is a conventional spring positioned over push rods 31 between horizontal plate 32 and actuator frame bracket 23. This will result in a varying force during both the upward and downward strokes of the reciprocating means D.

The use of the variable power means E, according to this invention, is a very important feature of this invention since it permits a convenient means of limiting the maximum force applied to reciprocating means D. A force is selected so that the patient can resist and successfully overcome the force and prevent the knee or elbow joint from further movement. This provides a reliable, safe method of operation. Its simplicity is such that the patient can understand that he can resist and successfully override the force applied by the apparatus and will not be hurt. This is a very necessary attribute of the apparatus since a patient who knows that he can override the machine will permit treatment closer to his pain tolerance and the treatment obviously is much more effective the closer the apparatus operates to the patient's ability to withstand pain. Operation of the apparatus must approach the threshhold of the patient's pain tolerance to be most effective but it must not exceed the threshhold pain.

Variable stroke means F includes variable timer means on reversible motor means 37 and limit rod means. The length of the stroke of reciprocating means D, as illustrated by DIM. B in FIG. 4, is a function of the length of the concomitant stroke of variable weight means 35, as illustrated by DIM. A in FIG. 4. The length of the stroke of variable weight means 35 is a function of the length of cable 39 which is wound up on drum 42, which in turn is a function of the angle of rotation of drum 42. Since drum 42 is driven by reversible motor means 37, the angle of rotation of drum 42 is controllably regulated by use of a variable timer means. Timer devices in a gear motor control circuit can be employed to automate the operation. Thus, the time that drum 42 rotates in one direction before reversing the motor 37 can be varied and controllably regulated. This is the primary means of control of the stroke of reciprocating means D. Although not shown, instead of a variable timer means on a reversible motor a crank mechanism can be used on a gear motor as the variable stroke means. In this embodiment, cable 39 can be attached to the free end of a crank handle and the stroke can be varied by varying the length of the crank handle, or at least by varying the point of connection of cable 39 to the crank handle.

A backup means of limiting the stroke of reciprocating means D is provided by using adjustable limit rod means. This means consist of a limit rod 51 which is connected at its upper end to an acutator rod 10 to a slide bearing 33 and a pin 34. Limit rod 51 passes through an opening in the actuator frame top 22. The lower end of limit rod 51 is threaded. An adjustable stop, such as nut 52, is threaded onto the lower end of limit rod 51. Adjustment of the adjustable stop 52 limits the maximum stroke of actuator rod 10. (Best shown in FIG. 4) One limit rod 51 is sufficient and is connected to one actuator rod 10. However, if desired, two limit rods can be utilized, connected to both actuator rods 10.

Two additional features with regard to variable stroke means F are that the speed of the stroke can be varied by using a variable speed gear motor on motor means 37 and a brake can be employed in the scheme if desired to maintain the limb in a certain position for a given amount of time.

METHOD OF OPERATION

One example of a scheme of operation for increasing the range of motion of a joint using the apparatus of this invention will be described. However, this example is intended as merely illustrative and not exclusive since the flexibility of the apparatus permits many treatment variations:

a. Raise the actuator frame means to an angle which is at or near the patient's present maximum range of motion and lock it into position;

b. Strap the limb to be treated in the upper limb and lower limb cradle;

c. Reduce the force well below the patient's pain tolerance by removing some of the weight discs from variable weight 35 and/or also adjusting the torsion spring of the rewind reel 36;

d. Start the motor 37 so that reciprocating motion begins;

e. Then increase the force in increments by adding weight discs to weight 35 until the maximum comfortable range is achieved. At this point the patient will be resisting and restricting the motion somewhat and if necessary can successfully override the force being applied;

f. Operate the apparatus until the patient has relaxed sufficiently and the soft tissues have stretched adequately so that the reciprocating means operates through its full stroke;

g. Adjust the timer means on the motor 37 so that the stroke of reciprocating means is extended so as to move the joint through an increased angle of motion;

h. After an appropriate period of time, raise the actuator frmae means through a small increment such as 2° or 3°, and adjust the stroke and/or force back downward again for this new setting.

The above process can be repeated as many times as necessary in the process of gradually increasing the range of motion in a joint.

Figure 5:
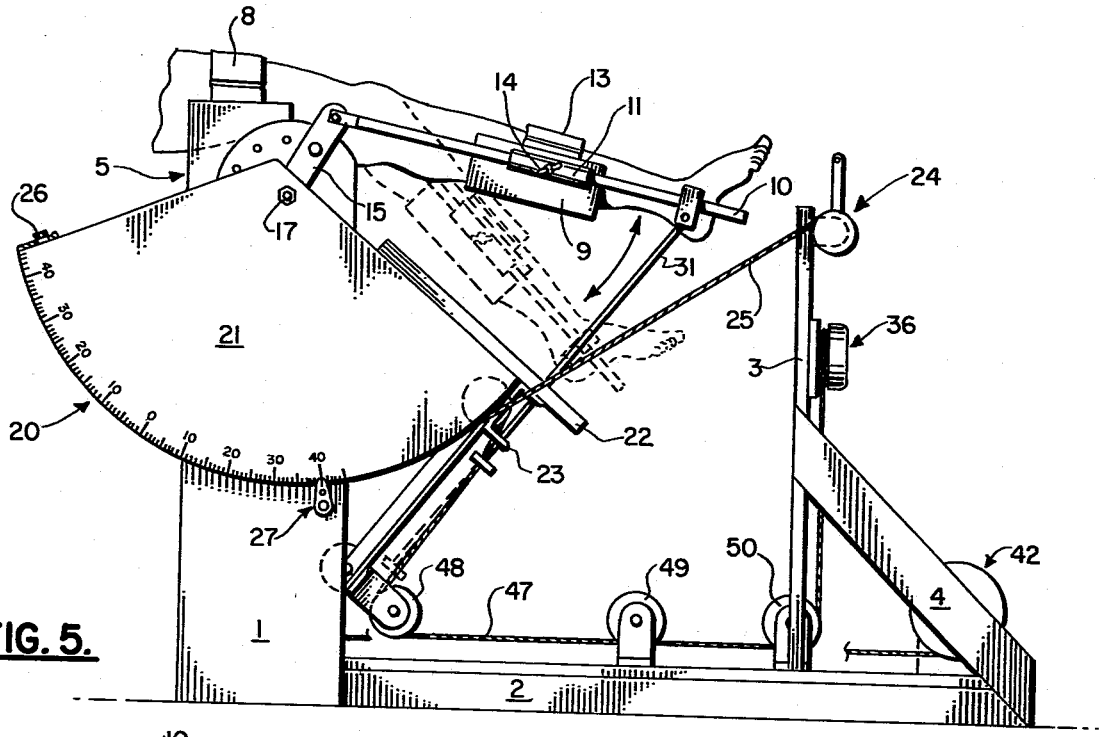
FIG. 5 is a side elevational view showing passive manipulation of a knee joint of a patient.
Figure 6:
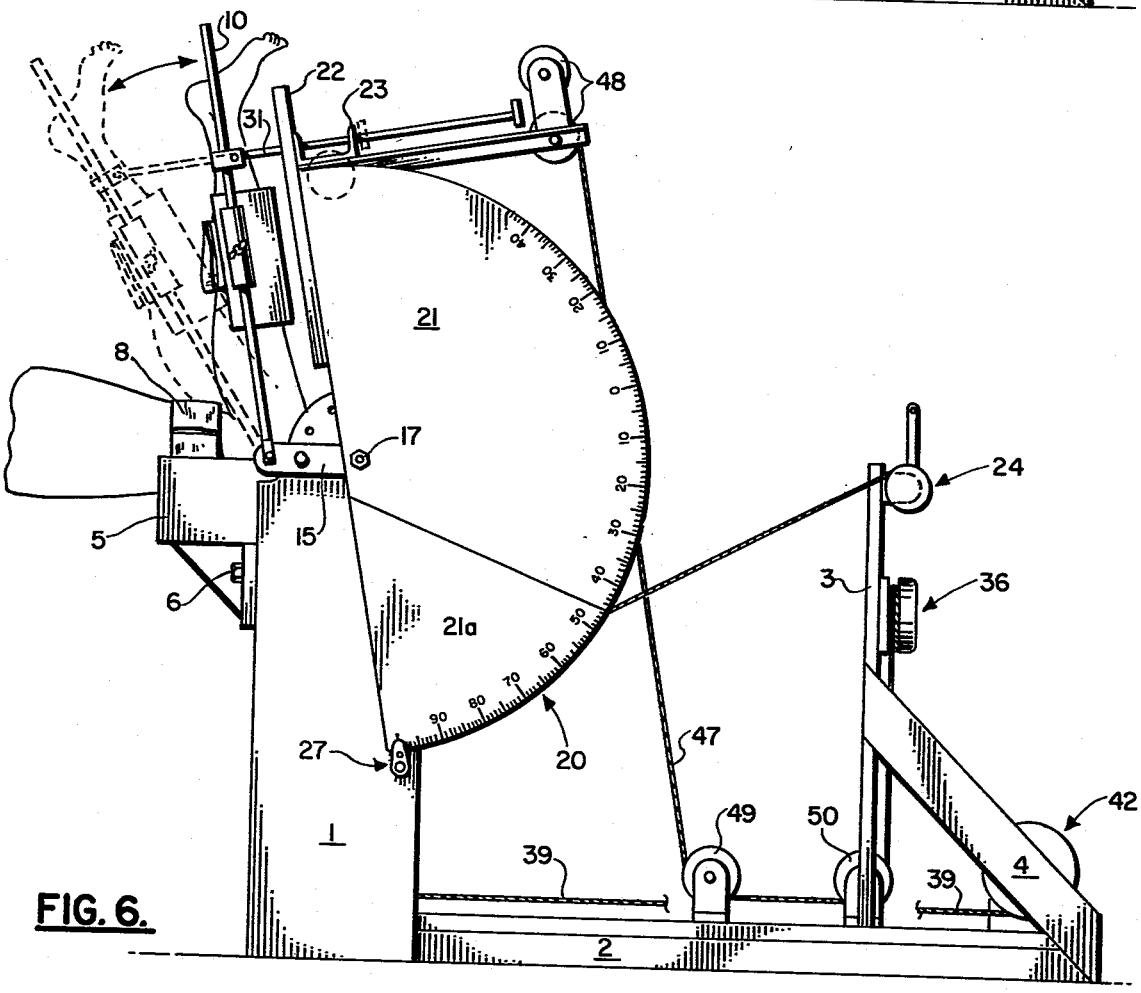
FIG. 6 is a side elevational view also showing passive manipulation of a knee joint of a patient but with the joint facing opposite to FIG. 5 and further illustrating the ability to add an extension onto the actuator frame side.
Figure 7:
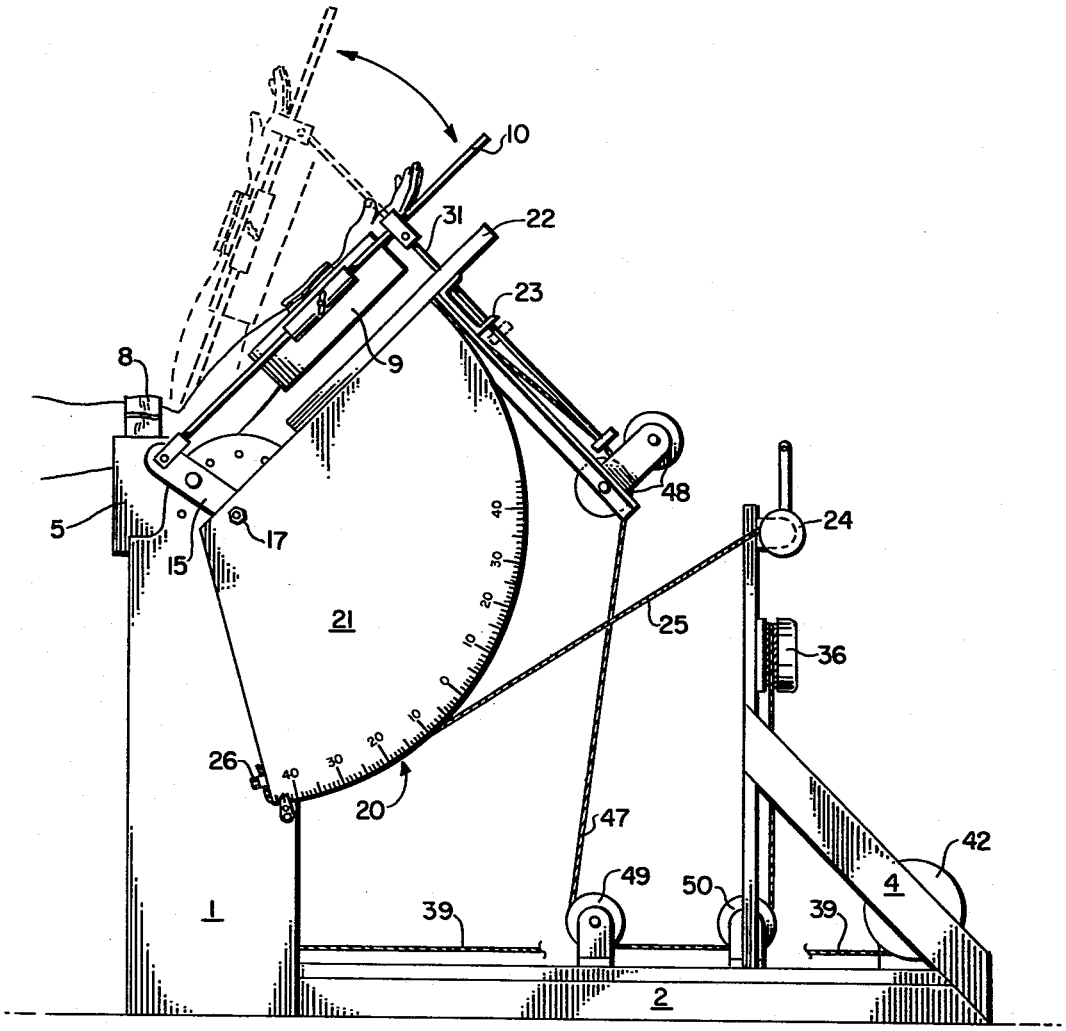
FIG. 7 is a side elevational view showing passive manipulation of an elbow joint of a patient.

FIGS. 5–7 are illustrative of the method of operating with the apparatus of this invention on either the leg or arm. FIG. 5 shows the apparatus set up to treat a knee joint with the patient in a sitting position. FIG. 6 shows the apparatus set up to treat the knee joint of a patient who is in a prone position. When the actuator frame means needs to be positioned in an upper position as illustrated in FIG. 6, a removable side extension 21*a* can be attached to actuator frame side 21 for operation. FIG. 7 shows the apparatus set up to treat an elbow joint.

The particular physical therapy apparatus illustrated employs cables, pulleys, weights, torsion springs, and electric motors including timer controls to provide control of the force applied to and stroke of the reciprocating means. However, it is obvious that other arrangements including, but not limited to, double acting air cylinders, solenoid valves, limit switches, and regulated air pressure sources can provide a similar degree of control.

While a reversible gear motor, cable drum, and cable are illustrated to actuate the weight means, it is obvious that other mechanisms such as crank assemblies, air or hydraulic operated cylinders, screw thread assemblies, or cam mechanisms which are all conventional and extensively used in the machinery field can be used as actuation means for the weight.

While a cable and winch arrangement has been illustrated as rotating means to position the actuator frame means, it is obvious that other devices such as gears, or chain and sprocket can be similarly utilized.

While in the foregoing specification a detailed description of a specific preferred embodiment of the invention was set forth for the purpose of illustration, it is to be understood that many of the details herein may be varied considerably by those skilled in the art without departing from the spirit and scope of the invention.

We claim:

1. A physical therapy apparatus for increasing the range of motion in a joint that has suffered a reduction in its normal mobility, said apparatus comprising:

support means for positioning and supporting the upper limb of an arm or leg;

cradle means for positioning and supporting the lower limb of the same arm or leg, said cradle means being adaptable to pivot relative to said support means such that the resulting axis of rotation coincides with the axis of rotation at the joint between the lower and upper limbs during pivotal movement of the lower limb relative to the upper limb, and said cradle means further being adaptable to pivot from an initial treatment position to a variable terminal treatment position;

positioning means for selectively setting the position of said cradle means relative to said support means at the initial treatment position;

reciprocating means adaptable to reciprocate said cradle means from the initial treatment position to the variable terminal treatment position so as to permit continuous reciprocal pivotal movement of the lower limb relative to the upper limb;

variable stroke means adaptable to vary and controllably regulate the stroke of said reciprocating means so as to permit the variable terminal treatment position to be controllably varied; and variable power means to operably drive said reciprocating means, said variable power means being adaptable to permit controlled selection of a predetermined amount of force that can be resisted and successfully overridden whenever too much pain or discomfort is experienced so as to achieve the desired physical therapy effect at the joint.

2. A physical therapy apparatus as described in claim 1 wherein said support means includes upstanding support means and an upper limb cradle rigidly attached to said upstanding support means, said upper limb cradle adaptable for positioning the upper limb of an arm or leg.

3. A physical therapy apparatus as described in claim 2 wherein said upstanding support means and said upper limb cradle include upper limb cradle height adjustment means to permit adjustment of the height of said upper limb cradle for aligning said upper limb cradle with said cradle means when the upper and lower limbs are positioned therein.

4. A physical therapy apparatus as described in claim 1 wherein said support means includes height adjustment means to permit adjustment of the height of said apparatus with respect to the joint.

5. A physical therapy apparatus as described in claim 1 wherein said support means includes transport means to permit easy movement of said apparatus from one location to another.

6. A physical therapy apparatus as described in claim 1 wherein said cradle means includes actuator rod means being adaptable to pivot relative to said support means such that the resulting axis of rotation coincides with the axis of rotation at the joint between the lower and upper limbs during pivotal movement of the lower limb relative to the upper limb, said actuator rod means further being adaptable to pivot from an initial treatment position to a variable terminal treatment position, and a lower limb cradle adaptable for positioning the lower limb of the arm or leg said lower limb cradle connected to and adjustably slidable along said actuator rod means to permit said lower limb cradle to be adjusted to a desired position.

7. A physical therapy apparatus as described in claim 6 wherein said reciprocating means are connected to said actuator rod means so as to be adaptable to reciprocate said actuator rod means from the initial treatment position to the variable terminal treatment position.

8. A physical therapy apparatus as described in claim 1 wherein said positioning means includes actuator frame means for selectively positioning said cradle means at the initial treatment position, said actuator frame means adaptable to pivot relative to said support means and the pivotal movement resulting therefrom adaptable to cause substantially coincident pivotal movement of said cradle means relative to said support means so as to move said cradle means to the initial treatment position, and said actuator frame means having indexing means to permit accurate selection of the desired initial treatment position for said cradle means.

9. A physical therapy apparatus as described in claim 8 wherein said positioning means includes rotating means adaptable to rotate said actuator frame means to the initial treatment position.

10. A physical therapy apparatus as described in claim 9 wherein said positioning means includes locking means adaptable to lock said actuator frame means into position after said rotating means have rotated said actuator frame means to the initial treatment position.

11. A physical therapy apparatus as described in claim 1 wherein said variable power means includes variable weight means.

12. A physical therapy apparatus as described in claim 11 wherein said variable weight means is adaptable to being connected and to transmitting driving force to said reciprocating means by pulley means.

13. A physical therapy apparatus as described in claim 12 wherein said variable weight means is adaptable to vertical movement through space such that the force from said variable weight means during its downward stroke through space is transmittable through said pulley means and is adaptable to provide the driving force for a concomitant upward stroke of said reciprocating means.

14. A physical therapy apparatus as described in claim 13 wherein said variable power means includes variable rewind reel means connected to said reciprocating means, said variable rewind reel means adaptable to exert a force on said reciprocating means lesser in extent than and opposite in direction to the force exerted by said variable weight means on said reciprocating means during the downward stroke of said variable weight means, and motor means adaptable to lift said variable weight means in a vertical movement in space through an upward stroke during which the force of said variable rewind reel means exerted on said reciprocating means becomes greater in extent than the force exerted by said variable weight means on said reciprocating means such that there is provided the driving force by said rewind reel for a concomitant downward stroke of said reciprocating means.

15. A physical therapy apparatus as described in claim 14 wherein said variable stroke means includes variable timer means on said motor means said motor means adaptable to being reversible such that the upward and downward stroke of said variable weight means are adaptable to being controllably varied so that the concomitant downward and upward stroke of said reciprocating means are adaptable to being controllably varied.

16. A physical therapy apparatus as described in claim 14 wherein said variable stroke means includes variable crank handle means on said motor means said motor means being non-reversible and adaptable to being run either at a single speed or variable speeds such that the upward and downward stroke of said variable weight means are adaptable to being controllably varied so that the concomitant downward and upward stroke of said reciprocating means are adaptable to being controllably varied.

17. A physical therapy apparatus as described in claim 8 wherein said variable stroke means includes adjustable limit rod means, said adjustable limit rod means having a limit rod connected with said cradle means and adaptable to be slidable through an opening in said actuator frame means and having an adjustable stop provided on said limit rod to controllably adjust the maximum slidable movement of said limit rod through the opening in said actuator frame means so that the maximum variable terminal treatment position of said cradle means is adaptable to being controllably adjusted.

18. A physical therapy apparatus for increasing the range of motion in a joint that has suffered a reduction in its normal mobility, said apparatus comprising:

support means for positioning and supporting the upper limb of an arm or leg;

cradle means for positioning and supporting the lower limb of the same arm or leg, said cradle means being adaptable to pivot relative to said support means such that the resulting axis of rotation coincides with the axis of rotation at the joint between the lower and upper limbs during pivotal movement of the lower limb relative to the upper limb, and said cradle means further being adaptable to pivot from an initial treatment position to a variable terminal treatment position;

positioning means for selectively setting the position of said cradle means relative to said support means at the initial treatment position, said positioning means including actuator frame means for selectively positioning said cradle means at the initial treatment position, said actuator frame means adaptable to pivot relative to said support means and the pivotal movement resulting therefrom adaptable to cause substantially coincident pivotal movement of said cradle means relative to said support means so as to move said cradle means to the initial treatment position, and said actuator frame means having indexing means to permit accurate selection of the desired initial treatment position for said cradle means;

reciprocating means adaptable to reciprocate said cradle means from the initial treatment position to the variable terminal treatment position so as to permit continuous reciprocal pivotal movement of the lower limb relative to the upper limb;

variable stroke means adaptable to vary and controllably regulate the stroke of said reciprocating means so as to permit the variable terminal treatment position to be controllably varied; and variable power means to operably drive said reciprocating means, said variable power means being adaptable to permit controlled selection of a predetermined amount for force that can be resisted and successfully overridden whenever too much pain or discomfort is experienced so as to achieve the desired physical therapy effect at the joint.

19. A physical therapy apparatus as described in claim 18 wherein said support means includes upstanding support means and an upper limb cradle rigidly attached to said upstanding support means, said upper limb cradle adaptable for positioning the upper limb of an arm or leg.

20. A physical therapy apparatus as described in claim 19 wherein said upstanding support means and said upper limb cradle include upper limb cradle height adjustment means to permit adjustment of the height of said upper limb cradle for aligning said upper limb cradle with said cradle means when the upper and lower limbs are positioned therein.

21. A physical therapy apparatus as described in claim 18 wherein said support means includes height adjustment means to permit adjustment of the height of said apparatus with respect to the joint.

22. A physical therapy apparatus as described in claim 18 wherein said support means includes transport means to permit easy movement of said apparatus from one location to another.

23. A physical therapy apparatus as described in claim 18 wherein said cradle means includes actuator rod means being adaptable to pivot relative to said support means such that the resulting axis of rotation coincides with the axis of rotation at the joint between the lower and upper limbs during pivotal movement of the lower limb relative to the upper limb, said actuator rod means further being adaptable to pivot from an initial treatment position to a variable terminal treatment position, and a lower limb cradle adaptable for positioning the lower limb of the arm or leg said lower limb cradle connected to and adjustably slidable along said actuator rod means to permit said lower limb cradle to be adjusted to a desired position.

24. A physical therapy apparatus as described in claim 23 wherein said reciprocating means are connected to said actuator rod means so as to be adaptable to reciprocate said actuator rod means from the initial treatment position to the variable terminal treatment position.

25. A physical therapy apparatus as described in claim 18 wherein said positioning means includes rotating means adaptable to rotate said actuator frame means to the initial treatment position.

26. A physical therapy apparatus as described in claim 25 wherein said positioning means includes locking means adaptable to lock said actuator frame means into position after said rotating means have rotated said actuator frame means to the initial treatment position.

27. A physical therapy apparatus as described in claim 18 wherein said variable power means includes variable weight means.

28. A physical therapy apparatus as described in claim 27 wherein said variable weight means is adaptable to being connected and to transmitting driving force to said reciprocating means by pulley means.

29. A physical therapy apparatus as described in claim 28 wherein said variable weight means is adaptable to vertical movement through space such that the force from said variable weight means during its downward stroke through space is transmittable through said pulley means and is adaptable to provide the driving force for a concomitant upward stroke of said reciprocating means.

30. A physical therapy apparatus as described in claim 29 wherein said variable power means includes variable rewind reel means connected to said reciprocating means, said variable rewind reel means adaptable to exert a force on said reciprocating means lesser in extent than and opposite in direction to the force exerted by said variable weight means on said reciprocating means during the downward stroke of said variable weight means, and motor means adaptable to lift said variable weight means in vertical movement in space through an upward stroke during which the force of said variable rewind reel means exerted on said reciprocating means becomes greater in extent than the force exerted by said variable weight means on said reciprocating means such that there is provided the driving force by said rewind reel for a concomitant downward stroke of said reciprocating means.

31. A physical therapy apparatus as described in claim 30 wherein said variable stroke means includes variable timer means on said motor means said motor means adaptable to being reversible such that the upward and downward stroke of said variable weight means are adaptable to being controllably varied so that the concomitant downward and upward stroke of said reciprocating means are adaptable to being controllably varied.

32. A physical therapy apparatus as described in claim 30 wherein said variable stroke means includes variable crank handle means on said motor means said motor means being non-reversible and adaptable to being run either at a single speed or variable speeds such that the upward and downward stroke of said variable weight means are adaptable to being controllably varied so that the concomitant downward and upward stroke of said reciprocating means are adaptable to being controllably varied.

33. A physical therapy apparatus as described in claim 18 wherein said variable stroke means includes adjustable limit rod means, said adjustable limit rod means having a limit rod connected with said cradle means and adaptable to be slidable through an opening in said actuator frame means and having an adjustable stop provided on said limit rod to controllably adjust the maximum slidable movement of said limit rod through the opening in said actuator frame means so that the maximum variable terminal treatment position of said cradle means in adaptable to being controllably adjusted.

34. A physical therapy method for increasing the range of motion in a joint that has suffered a reduction in its normal mobility, said method comprising:

supporting and securely holding in position the upper limb or an arm or leg on support means;

supporting and securely holding in position the lower limb of the same arm or leg on cradle means, said cradle means being adaptable to pivot relative to said support means such that the resulting axis of rotation coincides with the axis of rotation at the joint between the lower and upper limbs during pivotal movement of the lower limb relative to the upper limb, and said cradle means further being adaptable to pivot from an initial treatment position to a variable terminal treatment position;

selectively positioning said cradle means relative to said support means at an initial treatment position which does not exceed the allowable pain tolerance of the patient whose joint is being treated;

continuously reciprocating said cradle means with reciprocating means from the initial treatment position to the variable terminal treatment position so that said cradle means pivots relative to said support means and so as to provide a corresponding continuous reciprocal pivotal movement of the lower limb relative to the upper limb and further so that the resulting axis of rotation at the joint between the lower and upper limb coincides with the axis of rotation at the pivot point connecting said cradle means to said support means;

varying and controllably regulating the stroke of said reciprocating means such that the allowable pain tolerance of the patient is not exceeded; and varying and controllably selecting a predetermined amount of force on a variable power means to drive said reciprocating means such that the allowable pain tolerance is not exceeded so as to achieve the desired physical therapy effect.

35. A physical therapy method as described in claim 34 wherein the predetermined amount of force selected is an amount that can be resisted and successfully overridden by the patient whenever too much pain or discomfort is experienced.

36. A physical therapy apparatus for increasing the range of motion in a joint that has suffered a reduction in its normal mobility, said apparatus comprising:

support means for positioning and supporting the upper limb of an arm or leg;

cradle means for positioning and supporting the lower limb of the same arm or leg, said cradle means being adaptable to pivot reletive to said support means such that the resulting axis of rotation coincides with the axis of rotation at the joint between the lower and upper limbs during pivotal movement of the lower limb relative to the upper limb, and said cradle means further being adaptable to pivot from an initial treatment position to a variable terminal treatment position;

positioning means for selectively setting the position of said cradle means relative to said support means at the initial treatment position;

reciprocating means adaptable to reciprocate said cradle means from the initial treatment position to the variable terminal treatment position so as to permit continuous reciprocal pivotal movement of the lower limb relative to the upper limb;

variable stroke means adaptable to vary and controllably regulate the stroke of said reciprocating means so as to permit the variable terminal treatment position to be controllably varied; and variable power means to operably drive said reciprocating means, said variable power means including variable weight means, said variable power means being adaptable to permit controlled selection of a predetermined amount of force that can be resisted and successfully overridden by the patient whenever too much pain or discomfort is experienced to achieve the desired physical therapy effect at the joint.

* * * * *